US005976032A

United States Patent [19]

You

[11] Patent Number: 5,976,032

[45] Date of Patent: Nov. 2, 1999

[54] GOLF CLUB REINFORCED BY RIDGES

[76] Inventor: Chin-San You, No. 6, Lane 477, Sec. 2, Feng-Shyn Rd., Feng Yuan City, Taichung Hsien, Taiwan

[21] Appl. No.: 08/966,555

[22] Filed: Nov. 10, 1997

[51] Int. Cl.[6] ..... A63B 53/10; A63B 53/12

[52] U.S. Cl. ..... 473/319; 473/323

[58] Field of Search ..... 473/316–323; 280/819; 43/18.1

[56] References Cited

U.S. PATENT DOCUMENTS

| | | | |
|---|---|---|---|
| D. 93,756 | 11/1934 | Barnhart | D21/750 |
| 1,239,356 | 9/1917 | Patrick | 473/322 |
| 1,528,017 | 3/1925 | Gammeter | 473/327 |
| 1,962,804 | 6/1934 | Cassady | 473/323 |
| 1,979,430 | 11/1934 | Wright | 473/323 |
| 1,983,074 | 12/1934 | Durell | 473/323 |
| 1,996,298 | 4/1935 | Lard | 473/316 |
| 2,027,635 | 1/1936 | Cunningham | 473/317 |
| 2,126,717 | 8/1938 | Barnhart | 473/316 |
| 2,150,737 | 3/1939 | Chittick | 473/315 |
| 2,220,852 | 11/1940 | Scott | 473/323 |
| 5,022,652 | 6/1991 | Fenton | 473/323 |
| 5,251,896 | 10/1993 | Gerlach | 473/317 |
| 5,335,908 | 8/1994 | Bamber | 473/317 |
| 5,348,346 | 9/1994 | Unger | 280/819 |
| 5,545,094 | 8/1996 | Hsu | 473/317 |
| 5,653,644 | 8/1997 | Jaeckel | 473/316 |

*Primary Examiner*—Jeanette Chapman
*Assistant Examiner*—Stephen L. Blau
*Attorney, Agent, or Firm*—Browdy and Neimark

[57] ABSTRACT

A golf club is composed of a tapered shaft, a grip fastened at one end of the shaft, and a head fastened at another end of the shaft. The shaft is reinforced by a ridged structure consisting of at least two ridges extending along the direction of the longitudinal axis of the shaft.

2 Claims, 5 Drawing Sheets

GOLF CLUB REINFORCED BY RIDGES

FIELD OF THE INVENTION

The present invention relates generally to a golf club, and more particularly to a golf club provided with a ridged structure serving to reinforce the golf club.

BACKGROUND OF THE INVENTION

The conventional golf club is composed of a tapered shaft and a head fastened to the small diametrical end of the shaft. The hand grip is located at the large diametrical end of the shaft. Whenever a golf club is swung to hit the ball, the midsection of the shaft and the small end contiguous to the head are greatly exerted on by a force torque capable of causing the shaft to curve due to the application of force between the ball-hitting position of the head and the axis of the golf club. In other words, when a golf club is at work, the golf club must be able to withstand the force causing the golf club to curve and the torque causing the golf club to twist. In order to reinforce the tapered golf club of a fiber composite material, the conventional wisdom places the emphasis on the arrangement of the fiber braids making up the golf club.

In general, there are two conventional ways of reinforcing a golf club. As shown in FIG. 1, a golf club 10 is provided with a small protruded section 12. On the other hand, a golf club 15 is provided with a large protruded section 16, as shown in FIG. 2. The protruded sections 12 and 16 are basically similar in construction, with the only difference being that they are different in length. The protruded portions 12 and 16 have a cross section conical in shape, with the diameter of the cross section being gradually diminished towards both ends of the golf club. Such protruded portions of the conventional golf clubs as described above are effective in reinforcing the golf clubs; nevertheless they are integral parts of the golf clubs such that they are limited in design to give an added mechanical strength to the golf clubs. In addition, the golf clubs 10 and 15 of the prior art are not cost-effective in view of the fact that the formation of the protruded sections 12 and 16 calls for the additional amount of material. Moreover, the protruded sections 12 and 16 make the golf clubs 10 and 15 heavier.

SUMMARY OF THE INVENTION

It is therefore the primary objective of the present invention to provide a golf club with a ridged structure capable of reinforcing effectively the mechanical strength of the golf club.

It is another objective of the present invention to provide a golf club which is reinforced by a ridged structure and is relatively cost-effective.

It is still another objective of the present invention to provide a golf club which is reinforced by a ridged structure and is relatively light in weight.

The foregoing objectives, features, functions, and advantages of the present invention will be more readily understood upon a thoughtful deliberation of the following detailed description of the embodiments of the present invention with reference to the accompanying drawings.

DETAILED DESCRIPTION OF THE INVENTION

Figure 4:
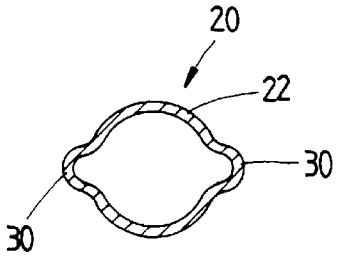
FIG. 4 shows a sectional view of a portion taken in the direction indicated by a line 4—4 as shown in FIG. 3.
Figure 3:
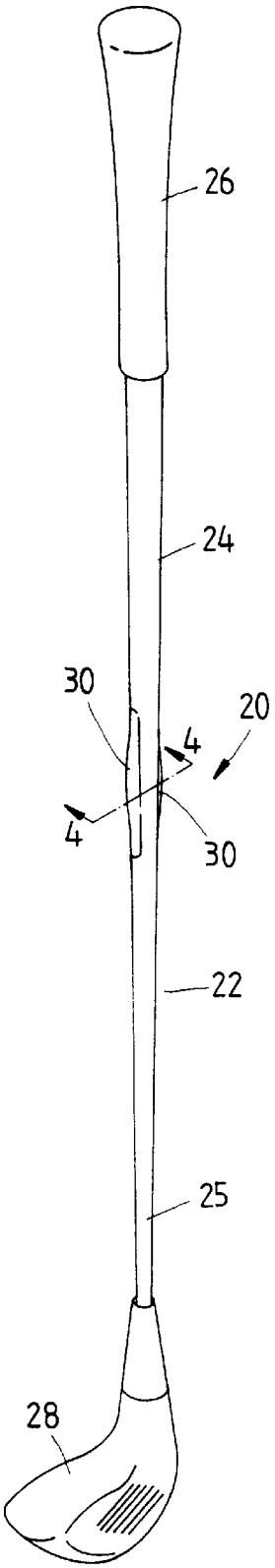
FIG. 3 shows a perspective view of a first preferred embodiment of the present invention.

As shown in FIG. 3, a golf club 20 of the first preferred embodiment of the present invention is made of a metal material or a nonmetal material such as the fiber composite material. The golf club 20 is composed of a tapered shaft 22 and a grip 26 located at the large diametrical end 24 of the tapered shaft 22. In the meantime, the tapered shaft 22 is fastened at the small diametrical end 25 thereof with a head 28. The tapered shaft 22 is reinforced by a reinforcing structure consisting of two ridges 30. The ridges 30 are located at the midsection of the tapered shaft 22 and are corresponding in length and height to each other. The ridges 30 extend on the outer surface of the midsection of the tapered shaft 22 along the direction of the longitudinal axis of the tapered shaft 22. The ridges 30 are opposite in location to each other, as shown in FIG. 4. The ridges 30 are composed of a crest and two sloping surfaces.

Figure 5:
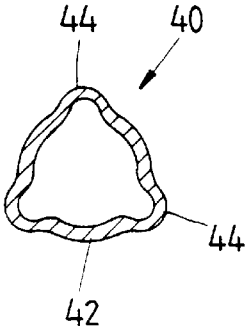
FIG. 5 shows a sectional view of a portion taken in the direction indicated by a line 4—4 as shown in FIG. 3 to illustrate a second preferred embodiment of the present invention.

As shown in FIG. 5, a golf club 40 of the second preferred embodiment of the present invention is composed of a shaft 42 which is provided with three ridges 44 arranged in the form of equilateral triangle.

Figure 6:
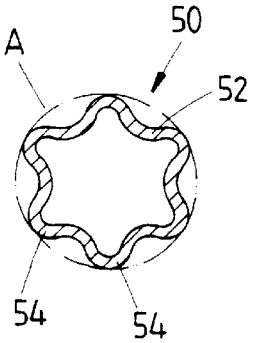
FIG. 6 shows a sectional view of a portion taken in the direction indicated by a line 4—4 as shown in FIG. 3 to illustrate a third preferred embodiment of the present invention.

A golf club 50 of the third preferred embodiment of the present invention is shown in FIG. 6 and is composed of a shaft 52 which is provided with six ridges 54 arranged equidistantly.

Figure 2:
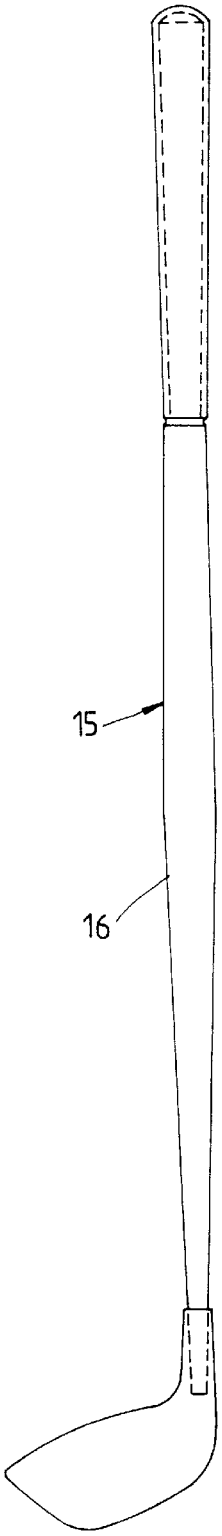
FIG. 2 (PRIOR ART)
FIG. 2 shows a perspective view of another prior art golf club provided with another reinforcing structure.
Figure 1:
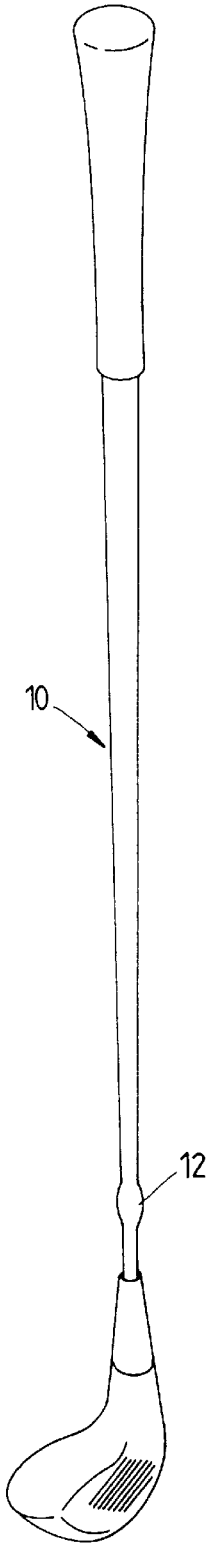
FIG. 1 (PRIOR ART)
FIG. 1 shows a perspective view of a prior art golf club provided with a reinforcing structure.
Figure 7:
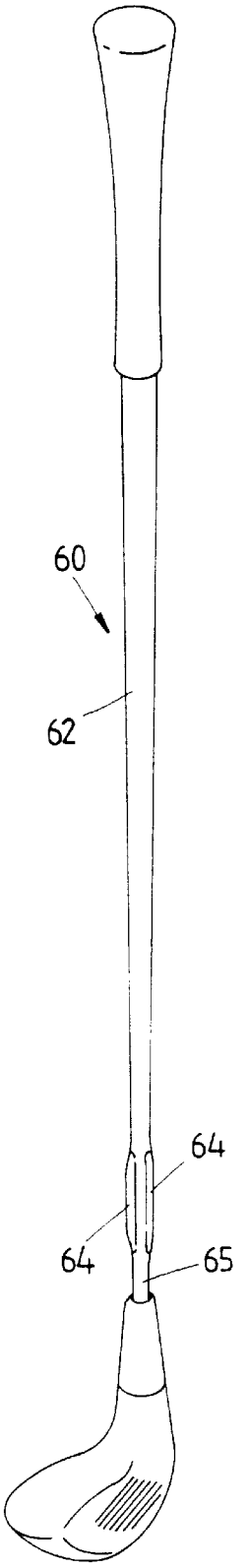
FIG. 7 shows a perspective view of a fourth preferred embodiment of the present invention.

The location of the reinforcing structure of the present invention is not confined to the midsection of the shaft of the golf club. For example, a golf club 60 of the fourth preferred embodiment of the present invention has a shaft 62 which is provided at the small diametrical end 65 thereof with two reinforcing ridges 64 opposite in location to each other, as shown in FIG. 7.

Figure 8:
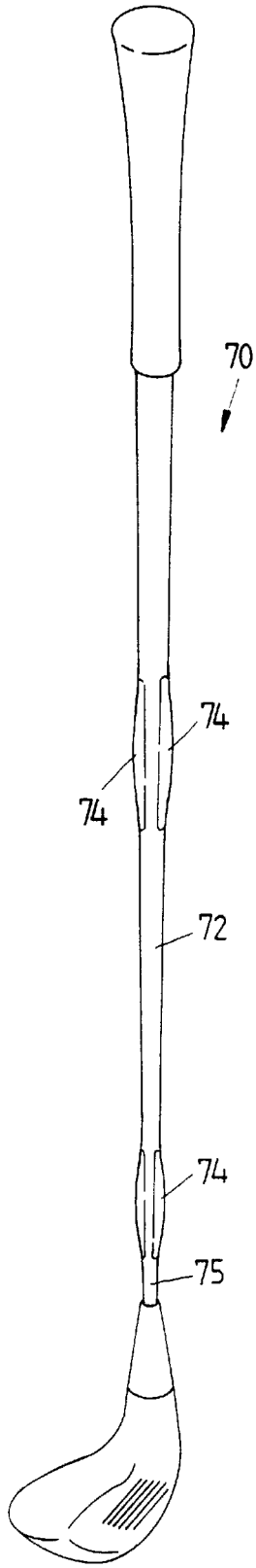
FIG. 8 shows a perspective view of a fifth preferred embodiment of the present invention.

Another variation of location of the reinforcing ridge of the present invention is shown in FIG. 8 in which a golf club 70 of the fifth preferred embodiment of the present invention is shown comprising a shaft 72 which is provided at both midsection thereof and small diametrical end 75 thereof with ridges 74.

Figure 9:
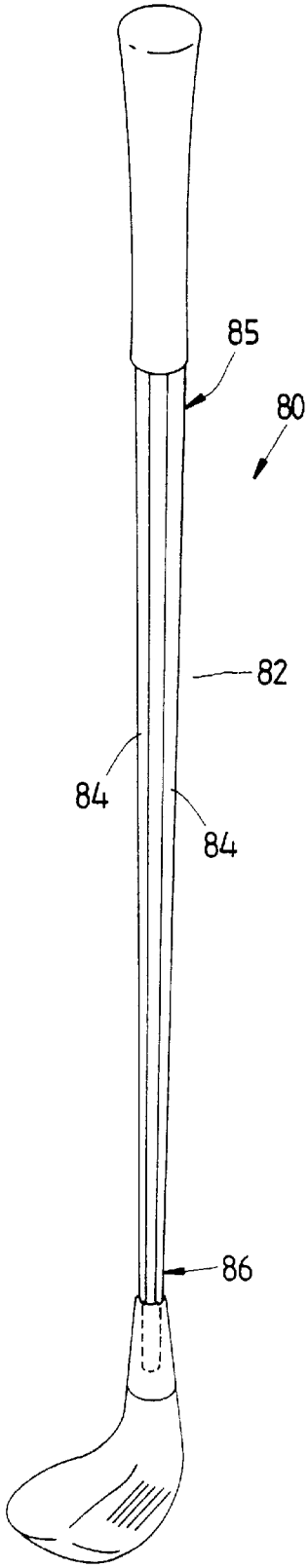
FIG. 9 shows a perspective view of a sixth preferred embodiment of the present invention.

The reinforcing ridges of the present invention may extend throughout the shaft of the golf club of the present invention. For instance, a golf club 80 of the sixth preferred embodiment of the present invention has a shaft 82 which is provided with ridges 84 which extend throughout the shaft 82, as shown in FIG. 9. However, the ridges 84 may or may not extend through the large diametrical end 85 and the small diametrical end 86.

Figure 10:
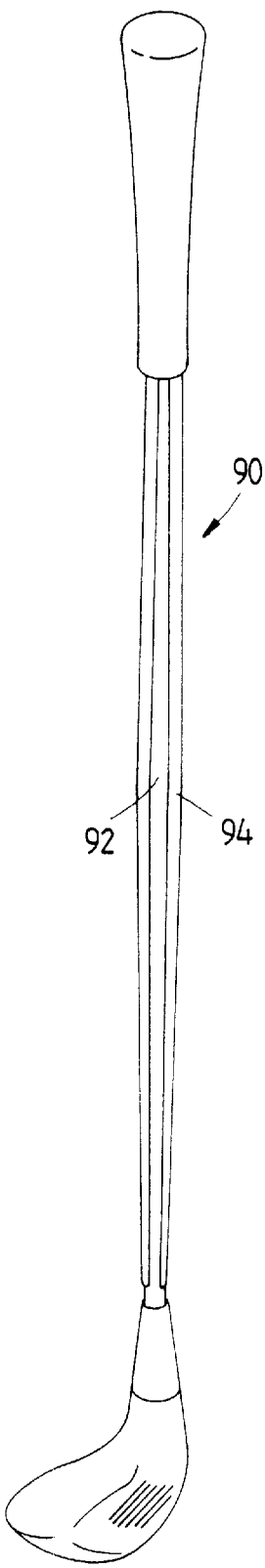
FIG. 10 shows a schematic view of a seventh preferred embodiment of the present invention.

As shown in FIG. 10, a golf club 90 of the seventh preferred embodiment of the present invention has a shaft 92 which is provided with ridges 94 extending throughout the shaft 92. The ridges 94 have a highest crest which is located at the midsection of the shaft 92.

Figures 11, 12, 13, 14:
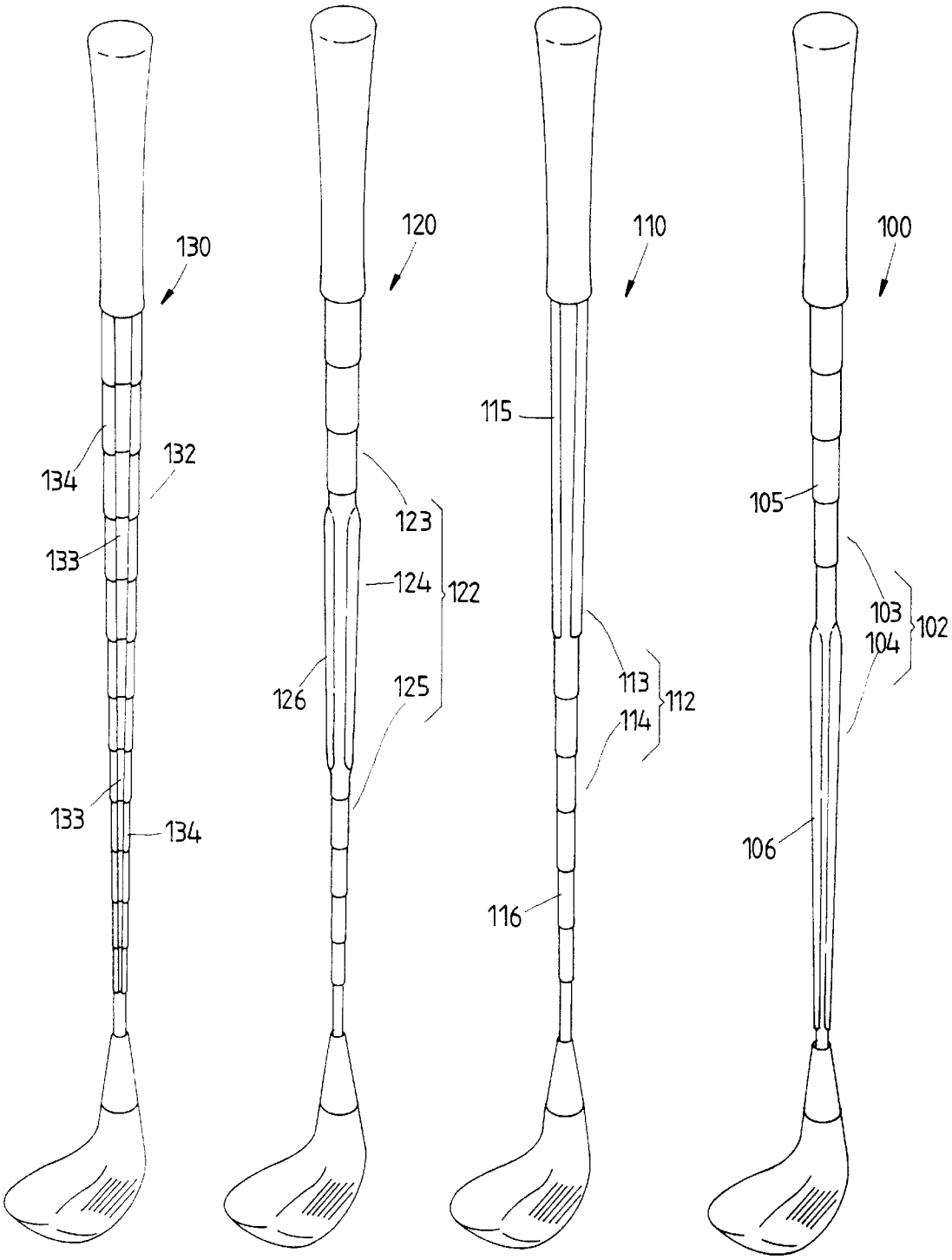
FIG. 11 shows a schematic view of an eighth preferred embodiment of the present invention.
FIG. 12 shows a schematic view of a ninth preferred embodiment of the present invention.
FIG. 13 shows a schematic view of a tenth preferred embodiment of the present invention.
FIG. 14 shows a schematic view of an eleventh preferred embodiment of the present invention.

As shown in FIG. 11, a golf club 100 of the eighth preferred embodiment of the present invention has a shaft 102 which is divided into two sections 103 and 104. The section 103 is composed of a series of steps 105 different in diameter from one another, whereas the section 104 is provided with ridges 106 extending throughout the section 104.

The stepped section 103 and the ridged section 104 of the golf club 100 described above may be reversed in location, as shown in FIG. 12 in which a golf club 110 of the ninth preferred embodiment of the present invention is shown to have a shaft 112 which is divided into a ridged section 113 provided with ridges 115, and a stepped section 114 provided with a series of steps 116.

As shown in FIG. 13, a golf club 120 of the tenth preferred embodiment of the present invention has a shaft 122 which is divided into three sections 123, 124 and 125. The sections 123 and 125 are stepped, whereas the section 124 is provided with ridges 126 and located between the stepped sections 123 and 125.

The stepped section and the ridged section of the present invention may be combined, as shown in FIG. 14 in which a golf club 130 of the eleventh preferred embodiment of the present invention is shown to have a shaft 132 which is divided into a series of stepped sections 133 each having a plurality of ridges 134 which are arranged equidistantly along the direction of the longitudinal axis of the golf club 130.

Figure 15:
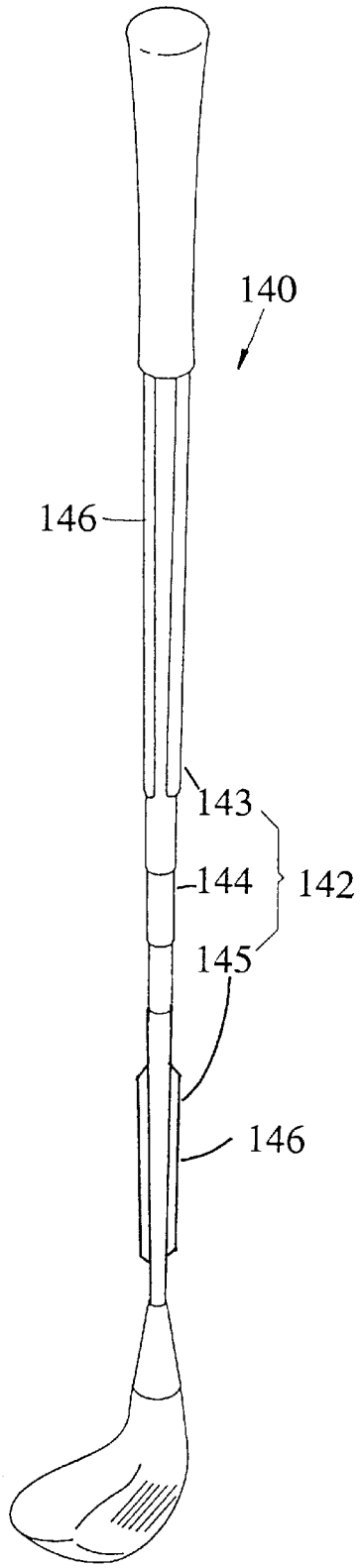
FIG. 15 shows a schematic view of a twelfth preferred embodiment of the present invention.

As shown in FIG. 15 in which a golf club 140 of the twelfth preferred embodiment of the present invention is shown to have a shaft 142 which is divided into three sections 143, 144 and 145. The sections 143 and 145 have ridges 146, whereas the section 144 is provided with steps located between ridged sections 143 and 145.

The embodiments of the present invention described above are capable of attaining the objectives of the present invention. The reinforcing ridges of the present invention can be arranged in various forms to provide a golf club with an excellent mechanical strength, torsional strength, flexural rigidity, and bending strength. In addition, the present invention is relatively cost-effective in terms of the amount of material that is used to make a golf club. For example, it takes less amount of material to make a golf club of the present invention, which has a diameter corresponding to the diameter of a prior art golf club as indicated by a dotted circle "A" in FIG. 6. As illustrated in FIG. 6, there is no material between two ridges 54. In other words, the reinforcing ridges of the present invention make the golf club of the present invention relatively light in weight.

What is claimed is:

1. A golf club reinforced by a ridged structure and composed of a tapered shaft, a grip at a large diametrical end of the tapered shaft, and a head fastened with a small diametrical end of the tapered shaft; wherein said shaft has the ridged structure consisting of two ridges opposite in location to each other and extending in the direction of a longitudinal axis of said shaft, wherein said shaft has at least two stepped sections respectively contiguous to said large diametrical end and said small diametrical end of said shaft, said shaft further having at least one ridged section located between said two stepped sections.

2. A golf club reinforced by a ridged structure and composed of a tapered shaft, a grip located at a large diametrical end of the tapered shaft, and a head fastened with a small diametrical end of the tapered shaft; wherein said shaft has the rigid structure consisting of two ridges opposite in location to each other and extending in the direction of a longitudinal axis of said shaft, wherein said shaft has at least two ridged sections respectively contiguous to said large diametrical end and said small diametrical end of said shaft, said shaft further having at least one stepped section located between said two ridged sections.

* * * * *